United States Patent [19]

Pfizenmaier et al.

[11] Patent Number: 4,641,070

[45] Date of Patent: Feb. 3, 1987

[54] DEVICE FOR DETERMINING AND ADJUSTING THE POSITION OF A WEB

[75] Inventors: Wolfgang Pfizenmaier, Neckargemünd; Heinrich Heidt, Neckarsteinach; Rolf P. Lehner, Kirchheim/Teck, all of Fed. Rep. of Germany

[73] Assignee: Heidelberger Druckmaschinen AG, Heidelberg, Fed. Rep. of Germany

[21] Appl. No.: 496,220

[22] Filed: May 19, 1983

[30] Foreign Application Priority Data

May 19, 1982 [DE] Fed. Rep. of Germany ..... 3218866

[51] Int. Cl.[4] ..... G05B 1/06; G01N 21/86; G01V 9/04

[52] U.S. Cl. ..... 318/640; 318/577; 318/591; 318/603; 250/548; 250/561

[58] Field of Search ..... 318/640, 577, 480, 576; 250/548, 560, 561, 557, 571; 318/603, 625, 592, 591, 632, 572, 696; 356/399, 400; 226/20; 198/345, 858; 242/57.1

[56] References Cited

U.S. PATENT DOCUMENTS

| | | | |
|---|---|---|---|
| 2,117,878 | 5/1938 | Friedemann | 318/480 X |
| 2,220,736 | 11/1940 | Stockbarger | 318/480 X |
| 3,746,957 | 7/1973 | Forster | 318/696 |
| 3,846,680 | 11/1974 | Guerci | 318/572 X |
| 3,852,719 | 12/1974 | Nishimura | 318/632 X |
| 3,885,872 | 5/1975 | Howe | 250/561 X |
| 3,912,193 | 10/1975 | Calvaer | 250/548 X |
| 4,112,344 | 9/1978 | Klein | 318/696 X |
| 4,119,901 | 10/1978 | Leenhouts | 318/696 X |
| 4,184,680 | 1/1980 | Massey | 250/548 |
| 4,234,837 | 11/1980 | Winslow | 318/640 X |
| 4,243,925 | 1/1981 | Gnuechtel | 250/548 X |
| 4,359,675 | 11/1982 | Miller, III | 318/640 X |
| 4,391,190 | 7/1983 | Metzler | 318/603 X |

*Primary Examiner*—William M. Shoop, Jr.
*Assistant Examiner*—Patrick C. Keane
*Attorney, Agent, or Firm*—Herbert L. Lerner; Laurence A. Greenberg

[57] ABSTRACT

A device for determining and adjusting the position of a web, the device having two sensor units each with a respective light source element directed towards the web and a respective photoelectric sensor element responsive to reflected light, a control unit responsive to respective output signals of the two sensor units, and a device connected to the control unit and fed by an adjusting signal from the control unit for adjusting the position of the web, including reflectors disposed at a side of the web facing away from the sensor units and projecting beyond respective opposite edges of the web, one of the two elements of one of the sensor units being directed towards one of the opposite edges of the web and the other of the two elements of the one of the sensor units being directed to a reference surface, the other of the two elements of the other sensor unit being directed towards the other of the opposite edges of the web and the other of the two elements of the other sensor unit being also directed to a reference surface, the adjusting signal fed from the control unit to the adjusting device being a function of the difference of the two output signals of the two sensor units.

4 Claims, 2 Drawing Figures

DEVICE FOR DETERMINING AND ADJUSTING THE POSITION OF A WEB

Figure 1:
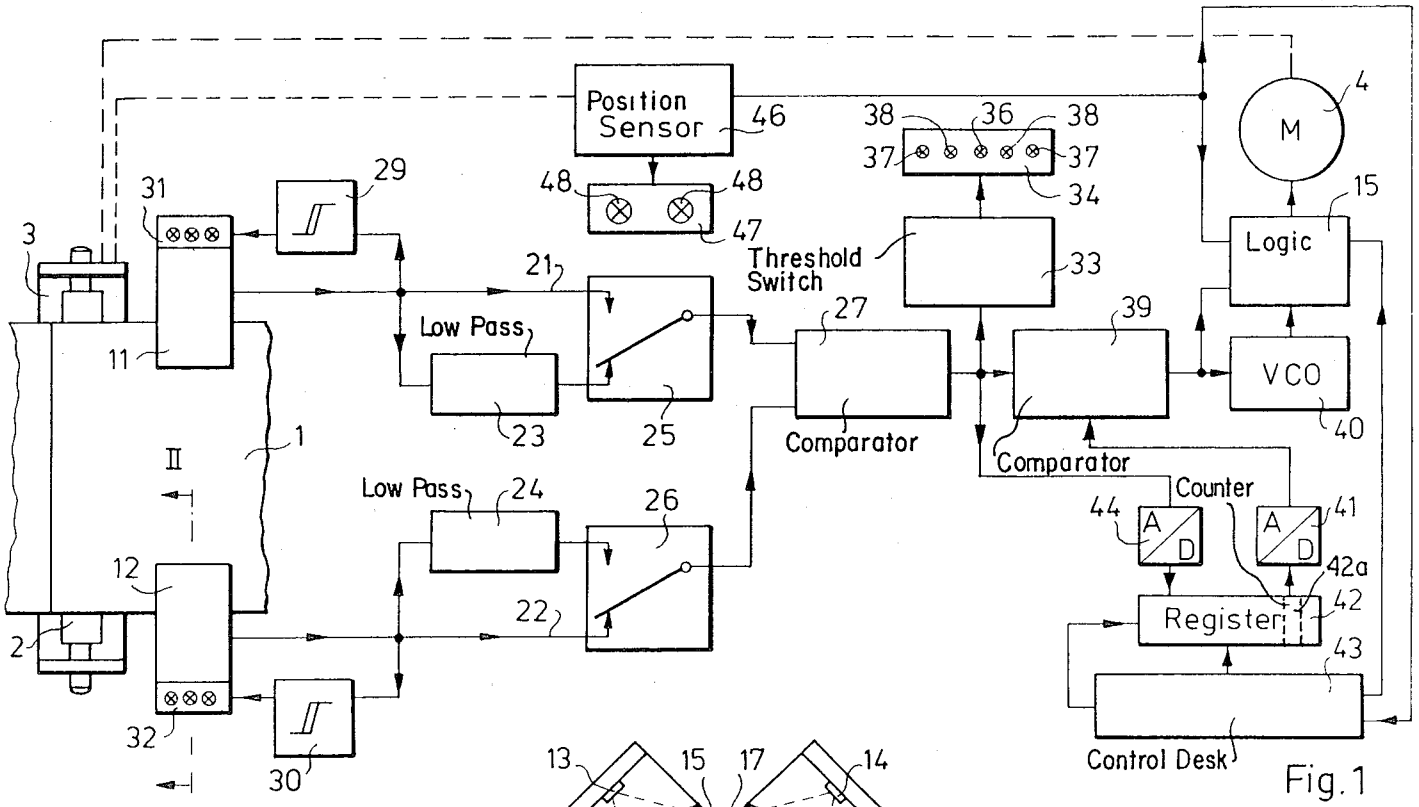

The invention relates to a device for determining and adjusting the position of a web, particularly for web printing presses, the device having two sensor units, each with a respective light source directed towards the web and a respective photoelectric sensor responsive to reflected light, one of either the light source or the sensor being directed towards one edge of the web and the other thereof to a reference surface, a control unit responsive to respective output signals of the two sensor units, and a device fed by an adjusting signal determining the position of the web from the control unit for adjusting the position of the web.

Such a device has become known heretofore from German Published Non-Prosecuted Application No. (DE-OS) 28 28 411. In this known device, the other sensor is fully directed towards the web so that the web itself serves as the reference surface, and the light reflected from the web is scanned by both sensors.

Considering the conventional characteristics or quality of the web scanned with such devices, especially in the case of paper webs, only a small portion of the light directed at the web by the sensor arrangement is reflected by the surface of the web, so that it is necessary to employ highly sensitive photoelectric sensors which have a relatively high susceptibility to failure or other trouble. Nevertheless, the light at the surface of the web must be concentrated at a small light spot in order to obtain the necessary light intensities, so that only a correspondingly small control range is available. The small amount of reflected light also means that fouling of the sensor arrangement due to dust, which is unavoidable during operation, has a very pronounced effect. In any case, it is necessary to generate a reference signal in order to take into account troubles or problems due to changes occurring over a period of time in the sensitivity or in the surface of the web, and this reference signal must originate from the surface of the web. The scanning of the surface of the web is order to generate a reference signal may lead to difficulties, however, if the web is printed or has other irregularities on the surface thereof, because this has an effect upon the reference signal which, in turn, has repercussions on the position of the web. Furthermore, the quantity of light falling on the photodetector of such reflex scanners is dependent upon the spacing between the web and the unit comprising the light source and the detector, so that, due to variations of this spacing, malfunction or failure in the control of the web position may also result. Such variations in spacing occur very often if the web has wavy edges. Finally, it is of disadvantage that, in the heretofore known arrangement, it is necessary to form a ratio between the signal dependent on the position of the web edge and the reference signal. Such a ratio formation does not provide any possibility of generating a clear and definite zero signal for the setpoint position of the web.

By constrast, it is an object of the invention to provide a device for determining and adjusting the position of a web which requires less sensitive sensor equipment and a larger light spot so that susceptibility to trouble is minimized and the control range is simultaneously enlarged and so that, furthermore, clear and distinct zero signals are obtained for the setpoint position of the web.

With the foregoing and other objects in view, there is provided, in accordance with the invention, a device for determining and adjusting the position of a web, the device having two sensor units each with a respective light source element directed towards the web and a respective photoelectric sensor element responsive to reflected light, a control unit responsive to respective output signals of the two sensor units, and a device connected to the control unit and fed by an adjusting signal from the control unit for adjusting the position of the web, comprising reflectors disposed at a side of the web facing away from the sensor units and projecting beyond respective opposite edges of the web, one of the two elements of one of the sensor units being directed towards one of the opposite edges of the web and the other of the two elements of the one of the sensor units being directed to a reference surface, the other of the two elements of the other sensor unit being directed towards the other of the opposite edges of the web and the other of the two elements of the other sensor unit being also directed to a reference surface, the adjusting signal fed from the control unit to the adjusting device being a function of the difference of the two output signals of the two sensor units.

In the device according to the invention, therefore, in contrast with the heretofore mentioned known device, the quantity of light which goes past the web edge is not lost, but is directed almost completely at the photoelectric sensors by the reflector which is provided. Accordingly, in the device according to the invention it is not the light reflected from the web which is important for position control, but rather that light which impinges upon the reflectors beyond the web and which, from there, reaches the sensors. The increase in light yield or efficiency achieved through the use of such reflectors permits the desired use of sensors having reduced sensitivity as well as the use of a larger light spot which leads to the enlarged control range. Furthermore, the device is insensitive to changes in the distance or spacing between the web and the sensor units, because the web essentially effects switch-off and the distance between sensor unit and reflector is constant. Because, furthermore, lateral displacement of the web causes the edges of the web to shift in opposite directions with respect to the light spots, so that the output signal of one sensor essentially increases in the same proportion as the output signal of the other sensor decreases, it is not the ratio of these two signals but the difference therebetween which is of importance with regard to position control. Forming the difference is easier to accomplish and, primarily when the signals are equal, provides a clear zero signal for the setpoint position of the web.

If the two output signals of the sesnor units are used directly for forming the adjusting signal, the web is always centered between the two sensor units. Thus, control of the centralized or center position of the web is effected.

Frequently, however, it is not desired to control the center position of the web, but rather to control the position of one of the edges which is then constant if the output signal of the sensor unit directed towards that edge is constant. If the web does not have a constant width, which is normally the case, the output signal of the other sensor units exhibits variations corresponding to the changing width. When the difference is formed, these variations must result in corresponding variations of the adjusting signal so that such a control of the position of the edge does not appear readily possible.

However, the device according to the invention also permits such control of the position of the edge if, in accordance with another feature of the invention, at least one of the two sensor units is coupled to the control unit or circuit via a low-pass filter, which eliminates the rapid variations of the output signal of the respective sensor unit, such variations being attributable to variations in the width of the web. In this case, the sensor unit coupled to the control circuit via a low-pass filter delivers a time-averaged reference signal, by means of which slow signal changes are compensated, for example changes resulting from fouling by dust, whereas, by means of the adjusting device, the position of the web is controlled in such a manner that the edge is kept constant with respect to the light spot of the sensor arrangement which is directly connected to the control circuit or unit.

As mentioned hereinbefore, use of a different signal as the control signal has the advantage that the setpoint position of the web is defined by a clear and distinct zero signal. Furthermore, the setpoint position can, in a relatively simple manner be shifted with respect to the sensor units by providing, in accordance with a further feature of the invention, means for feeding a control signal to the control unit for addition to the output signal of one of the sensor units. The addition of such a control signal causes the adjusting signal to have the value zero if the output signals of both sensor units are unequal and yield a difference signal which is equal and opposite to the control signal. The addition of the control signal is accomplished, in a relatively simple manner, in accordance with an added feature of the invention by providing means for feeding the output signals of the two sensors units to a first comparator having an output signal and means for feeding the latter's output signal as well as the control signal to a second comparator having an output which delivers the adjusting signal.

A special problem in such devices for controlling the position of webs is that, after setting up the press to take the web, the web which is drawn in by hand is not precisely in the setpoint position of the control device, so that, when switching over or converting from manual to automatic operating mode, there is a relatively large error or control deviation and the control process sets in very abruptly. This imposes a very great strain on the web and, particularly in the case of paper webs, this may readily result in tearing of the web. Furthermore, it is also normally desired that the setpoint position of the control device should agree with the actual manually-set position of the web, but achieving such agreement with the desired accuracy is not generally possible.

The device according to the invention also solves this problem in a very simple and absolutely reliable manner by providing means for storing, at the instant of conversion to the automatic operating mode, that output signal of the first comparator which is generated during the manual operating mode, and means for feeding the stored output signal of the first comparator to the second comparator as a control signal during the automatic operating mode, so that, in this manner, the position of the web which was set for manual operating mode is automatically assumed with high accuracy as the setpoint position for the control. The storage and entering of the output signal of the first comparator as the control signal for the second comparator may occur in an especially simple fashion in accordance with yet another feature of the invention by providing an analog-to-digital converter for converting the analog output signal of the first comparator circuit into a register having a digital signal, a digital memory for receiving the digital signal at the instant of conversion from the manual to the automatic operating mode, and a digital-to-analog converter for converting the signal received in the digital memory to the control signal fed to the second comparator, the content of the digital memory being variable for randomly changing the control signal. In this connection, in accordance with other alternative features of the invention the digital memory is formed by a counter or is coupled to a counter having means for feeding a clock signal thereto so as to enter the control signal.

Because the device according to the invention permits, in manual operating mode, the making of an ajdustment which is expressed in the output signal of the sensor units and, in automatic operating mode, the setting of the position of the web by an adjusting signal which has the value zero when the web is in the setpoint position, the device for adjusting the position of the web must be of such construction that it permits both slight adjustment of the position of the web manually and also rapid and accurate response to the adjusting signal. To ideally meet these requirements, in a preferred embodiment of the invention, the device for changing the position of the web comprises a stepping motor which has means for feeding thereto, in automatic operating mode, drive pulses derived from an output signal of an oscillator which is voltage-dependent in the frequency thereof, means for feeding to the oscillator the adjusting signal delivered from the control unit as a frequency-determining signal, and means for feeding, in the manual operating mode, drive pulses derivable from a clock signal directly to the oscillator. The use of a stepping motor has the advantage that, in manual operating mode, adjustment travel can be determined with great accuracy because it is known how great the adjustment travel is for each individual drive pulse and, fruthermore, in automatic operating mode, the control speed depends upon the difference between the actual and the setpoint positions because the frequency of the voltage-controlled oscillator is dependent upon the amplitude of the adjusting signal, so that the voltage-controlled oscillator increases the number of drive pulses fed to the stepping motor per unit of time in proportion with the increase in the amplitude of the adjusting signal and, therefore, if there is a larger error or control deviation, the adjustment operation occurs at a greater speed than in the case of a small error or control deviation. If the adjusting signal is zero, the frequency of the voltage-dependent oscillator is also zero, so that no drive pulses are fed to the stepping motor and, accordingly, the web is kept in the existing position thereof.

A special advantage of this embodiment of the device according to the invention is that control desks or consoles from which it is possible to initially set and change the position of the web, may be disposed at any desired location on the press because only relatively simple equipment is required to generate the drive pulses or control pulses necessary for adjustment, pulses with which it is possible to vary the content of the memory containing the control signal. Special equipment for position feedback and the like is unnecessary. Precisely in this respect it is of particular advantage that the user of such a device knowns precisely that a control pulse or a drive pulse moves the servo-motor by one step and what lateral displacement or shift of the web corresponds to such a step.

Because these clear relationships between the control signals and the drive signals in conjunction with the use of a stepping motor make it possible to dispense with complicated feedback systems, it is sufficient to provide simple indicating devices for informing the user. Such devices are clearly monitorable and merely indicate whether the web is in the optimum control range or not. Thus, in accordance with yet a further feature of the invention, an indicating device indicating the position of the web with respect to the sensor arrangement is coupled to the output of the first comparator. Further, in accordance with the invention, at least one of the two sensor units includes an indicating device, more particularly, a light-emitting diode array or panel, for indicating the position of the respective sensor unit relative to the respective edge of the web. Such a device is necessary, especially if the sensor arrangement operates with IR light so that the light spot is not visible to the human eye.

A particular advantage of the aforediscussed, special construction of the device for adjusting the position of the web and of the associated control and indicating equipment is also that a plurality of control and indicating means are connectible in parallel without interfering with one another in any way whatsoever, and is also that it is possible to provide various mutually parallel means by which drive pulses are fed to the stepping motor. Therefore, in accordance with concomitant features of the invention the stepping motor is able to be fed with drive pulses not only from the voltage-controlled oscillator and the manual adjustment means, but also, if required, as a function of the output signal of a position sensor which responds to deviations from the centered position of the device for adjusting the position of the web, the output signal of which is feedable to the control unit for the purpose of returning the device into the centered position thereof. Such a return of the device into the centered position thereof may occur at the beginning of each adjustment operation, the centered position being thereby also accurately attained. However, this may also occur in the automatic operating mode, whenever the edge of the web leaves the control range of the sensor units, so as to effect the automatic return of the web into the control range. In the latter case, further control of the device for adjusting the position of the web is assumed by the automatic control system as soon as the web has again come into the control range without any necessity for the device for adjusting the position of the web to completely return to its own centered position.

Other features which are considered as characteristic for the invention are set forth in the appended claims.

Although the invention is illustrated and described herein as embodied in a device for determining and adjusting the position of a web, it is nevertheless not intended to be limited to the details shown, since various modifications and structural changes may be made therein without departing from the spirit of the invention and within the scope and range of equivalents of the claims.

Figure 2:
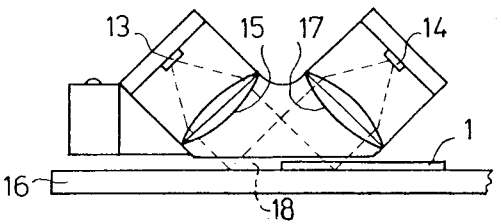

The construction and method of operation of the invention, however, together with additional objects and advantages thereof will be best understood from the following description of specific embodiments when read in connection with the accompanying drawings, in which:

FIG. 1 is a diagram, partly in block form and partly schematic, of a device for determining and adjusting the position of a web according to the invention; and FIG. 2 is a fragmentary sectional view of FIG. 1 taken along the line II—II in direction of the arrows.

Referring now to the drawing and first, particularly, to FIG. 1 thereof, there is shown a web 1 extending over deflection rollers which are disposed parallel to one another in a frame 3, only the upper one of the deflection rollers 2 being visible in FIG. 1. The frame 3 is pivotable about an axis which is basically parallel to the center line of the web 1 and is located at a considerable distance from the upper deflection roller 2 visible in FIG. 1, so that pivoting of the frame 3 about this axis results in an approximately axially parallel movement of the upper deflection roller 2 which, with this motion, entrains the web 1, so that by pivoting the frame 3 it is possible to effect a lateral displacement of the web 1. The frame 3 is mechanically coupled to a motor 4 which effects the desired adjustment of the frame 3 pursuant to the drive signals supplied thereto.

In the illustrated device, the position of the web 1 is monitored by two sensor units 11 and 12 each of which is directed to one of the two edges of the web 1. As can be seen from FIG. 2, each sensor unit 11 or 12 is made up of a light source 13 and a photoelectric sensor 14. The light source may be formed, especially, of a GaAs transmitting diode which generates radiation in the range of infrared light. This radiation is converted by a lens 15 into a parallel bundle of rays which are reflected in direction towards the photoelectric sensor 14 from a reflector 16 spaced from and opposite to the sensor arrangement, the photoelectric sensor 14 being a light detector sensitive to IR radiation. The radiation is focused onto the light detector 14 by means of an attached lens 17. The amount of light incident on the light detector 14 depends upon how far the web 1 projects over the reflector 16 in the region of the light spot 18 which is generated by the aforementioned bundle of rays upon the surface of the reflector 16. Because the web 1 absorbs and diffuses the incident light, the intensity of the light reaching the light detector 14 is weakened all the more, the farther the web 1 covers the region of the reflector 16 upon which the light generated by the light source 13 impinges.

The output signals of the sensor unit 11 and 12, which are amplified if necessary or desirable, are fed via a lead 21 and 22, respectively, directly as well as via a low-pass filter 23 and 24, respectively, to a switch 25 and 26, respectively, which permits the sensor unit 11 or 12, respectively, to be connected to an assigned input of a comparator 27 selectively either directly or via the assigned low-pass filter 23 and 24, respectively. In addition, the output signal of each sensor unit 11 and 12 is fed to a two-step threshold-value switch 29 and 30, respectively, which defines a window. The output signal of the threshold-value switch 29 and 30, respectively, is supplied to a respective indicating device 31, 32 having three light-emitting diodes 33. The configuration is such that, in the case of a medium amplitude of the output signals of the sensors 11 and 12, the, for example, green middle light-emitting diode of the respective indicating device, 31 and 32 is made to light up so as to indicate that the sensor arrangement 11 and 12, respectively, is approximately centralized with respect to the respective edge of the web 1. If the amplitude of the output signal is too high or too low, one of the, for example, red outer light-emitting diodes of the respective indicating devices 31 and 32 is made to light up so as to indicate that the light spot of the sensor arrangement overlaps the web by too much (low output signal) or by too little (high output signal) in order yet to ensure an adequate control range. This indication or display of the position of the sensor units 11 and 12 with respect to the edge of the web 1 facilitates the adjustment of the sensor arrangements to the edges of the web 1 when setting up the device because, when IR radiation is used, the light spot generated by the sensor arrangement is not visible with the naked eye.

Similarly to the output signals of the sensor units 11 and 12, an output signal of a comparator 27 is also fed to a threshold-value switch 33 to which another indicating device 34 is connected. This indicating device 34 shows whether or not the device is operating in optimum control range. If the, for example green, middle lamp 36 is lit, the system then is operating in the optimum control range. If one of the, for example red, outer lamps 37 is lit, this indicates that the web 1 has run out of the control range at the particular side indicated. Additional lamps 38 disposed between the middle and the outer lamps, and being yellow, for example, indicate that the control has reached a critical range at the respective side indicated, so that measures may be taken to correct the position of the web 1 before the control operation is interrupted. It is understood that the elements 36, 37 and 38 identified as "lamps" may be formed by light sources of any kind i.e. especially by light-emitting diodes, just as the light sources of the indicating devices 31 and 32 identified as "light-emitting diodes" may also be formed by incandescent lamps or other light sources.

The output signal of the comparator 27 is additionally supplied to an input of another comparator 39 which compares the output signal of the first comparator 27 with a reference signal and feeds to a voltage-dependent oscillator 40 an output signal which is proportional to the difference between the output signal of the first comparator 27 and the reference signal fed to the oscillator 40. The reference signal is supplied to the comparator 39 from a D/A (digital-to-analog) converter 41 which converts a digital signal contained in a register having a digital memory 42 into an analog signal suitable for the comparator 39. The content of the register 42 is determined through an input for a control desk 43 which permits pulse trains to be generated and to be supplied to the register 42 in order thereby to change the status of the register 42, it also being possible to accept a digital signal from an analog/digital converter 44 which is connected to the output of the first comparator 27 and to convert an output signal of the latter into a digital signal suitable for reception by the register 42.

A voltage-dependent oscillator (VCO) 40 generates as its output signal an AC voltage having a frequency proportional to the input signal fed from the comparator 39. If the output signal of the comparator 39 is zero, the frequency of the output signal of the VCO is also zero, and this frequency increases in proportion with the output voltage of the second comparator 39. The AC voltage is converted in a conventional manner, not further or more closely described herein, into pulse trains which form drive pulses for the stepping motor 4. These drive pulses are supplied to the stepping motor 4 via a logic system 45 of conventional construction which determines the direction of rotation of the stepping motor 4, amongst other things, depending upon whether the difference of the input signals supplied to the comparator 39 is positive or negative. Furthermore, the logic system 45 blocks transmission of the drive pulses generated by the VCO 40 if the device of the invention is not set to automatic mode, or if a position sensor 46 coupled with the frame 3 has detected that the frame 3 has reached the end of the adjustment range thereof. The logic system 45 also permits drive pulse trains generated by the control desk or console 43 to be fed directly to the stepping motor 4, if it is so desired when setting up the device manually, to obtain a specific change in the position of the web 1. Connected to the position sensor 46 is yet another indicating device 47 containing two light sources 48, a respective one of which lights up if the frame is located outside of a center position but has not yet reached an outermost end position. Both lamps are out when the frame is precisely in the center position as well as when it has reached an end position, but the remaining indicating devices and the prevailing operating status clearly indicate whether the frame is in the center position thereof or in one of the outer end positions thereof. In the latter case especially, the control process is automatically interrupted and measures are introduced to move the frame back towards the center position thereof so that correct and trouble-free position control is assured.

The device according to the invention affords a number of different operating conditions. When setting up the press, the operating condition "centering" is initially set at the control desk or console 43. In this connection, the output signal of the position sensor 46 is used to generate in the control desk 43 a drive pulse train which is fed via the logic system 45 to the stepping motor 4, causing the frame 3 to be brought into the center position thereof. The entire control system is thus switched off. It is then possible to draw in the web 1 which, for example, is a paper web when the device according to the invention is used in conjunction with a printing press. Thereafter, the sensor units of the reflection light barriers can be adjusted or set to the edges of the web 1 so that they are displaced transversely to the web 1 on suitable supports. The reflector 12 need not be adjusted if this reflector extends over the entire width of the device. The indicating devices 31 and 32 at the sensor units 11 and 12, respectively, indicate the position with respect to the edges of the web 1 and, therefore, afford simple adjustment to the optimum control range.

Thereafter, by switching over to "manual mode" it is possible, at the control desk or console 43, to bring the web 1 into a desired position. This is effected by actuating appropriate switches (not otherwise described in any greater detail) at the control desk or console, as a result of which the stepping motor 4 directly receives, via the logic 45, individual drive pulses or even drive pulse trains derived from a lock signal in order to effect the desired setting or adjustment. In accordance with the shift relative to the sensor units 11 and 12 effected thereby, the output signals of the latter vary so that the output signal of the comparator 27 is not equal to zero. The indicating device 34 shows whether the web 1 remains in the optimum control range or not. If necessary or desirable, the position of the sensor units 11 and 12 could be corrected in order thereby to set the control range optimally to the current setpoint position of the web 1.

When these adjustment operations are completed, it is possible to switch over to "automatic" at the control desk or console 43. In this connection, the output signal delivered by the comparator 27 at the instant of switchover is transferred via the A/D converter 44 into the register 42 and, following renewed D/A conversion, is fed to the second comparator 39 as a reference signal so that, when switching over to automatic, the output signal of the second comparator 39 is zero. Accordingly, no drive pulses are generated which could be fed to the stepping motor 4, so that the device remains in the once set position.

If, in automatic operating mode, changes should occur in the position of the web, these changes effect a consequent change of the output signal of the first comparator 27, so that this output signal is different from the reference signal supplied by the D/A converter 41. Correspondingly, the output signal of the comparator 39 assumes a final or finite value, and the VCO 40 generates an AC voltage with a frequency proportional to the output signal of the comparator 39. This output signal is fed as a pulse train via the logic system 45 to the stepping motor 4 in such a manner that, depending upon whether the signal from the comparator 39 is positive or negative, the motor 4 is turned in a direction resulting in the return of the web 1 to the setpoint position thereof and thus resulting in a reduction of the output signal of the second comparator 39. A special advantage of this arrangement is that the control speed is proportional to the deviation of the web 1 from the setpoint position thereof i.e. in the case of a large deviation, there is rapid control, whereas small deviations are corrected at correspondingly low speed.

Besides this automatic position correction, it is also possible, during automatic operating mode, to effect a manually introduced position correction. However, this is not done simply by feeding the stepping motor 4 via the logic system 45 with drive pulses from the control desk 43, but rather, the reference signal fed to the comparator 39 is altered by changing the content of the digital memory 42 of the register. Such a register may include a counter 42*a* or the digital memory 42 thereof may be formed, for example, by a counter, the status of which may be increased or reduced by the feeding of pulses so that a very accurate variation of the reference signal may be possible, the effect of which upon the position of the web 1 may be accurately predicted.

If, for whatever reason, the web 1 drifts outwardly so far that the frame 3 reaches the end position thereof, the signal from the position sensor 46 delivered to the control desk 43 causes pulse trains to be fed to the motor 4, thus turning the pivoting frame 3 back in the direction of the center position thereof until normal automatic control is instituted again or until the center position is reached. In this manner, it is possible to extend the control range of the device over the entire range of mechanical adjustment.

The hereinafore-described automatic operating mode permits control of the position of the web 1 with respect to the center or to one of the two edges thereof. In the case of the center control, the output signals of the sensor units 11 and 12 are fed directly to the first comparator 27 via the switches 25 and 26. Accordingly, the output signal of the comparator 27 is then always zero when the web 1 projects into the ray bundles of the two sensor arrangements equally. Deviations in the width of the web are taken into account in that they act uniformly i.e. symmetrically, on both sensor units. Accordingly, the automatic control causes the position of the web center always to be maintained. If, on the other hand, one of the two sensor units, for example the sensor units 11, is connected by means of the associated switch 25 to the comparator 27 via a low-pass filter 23, then the comparator 27 receives from the sensor unit 11 a reference signal which does not exhibit any short-term deviations, but, apart from longterm variations forms a reference signal which is basically constant with respect to time. Accordingly, the position of the web 1 is controlled in such a manner that the output signal of the sensor unit 12 is also basically constant, which is true only if the position of the web edge remains constant with respect to the sensor unit. Accordingly, in this case, position control related to the web edge occurs. In this connection, by means of the switches 25 and 26, it is possible to select that web edge the position of which is to be kept constant.

It is also possible to switch from center control to web edge control readily and also from one web edge to the other without occurrence of any jumps or transfers. Furthermore, it is of great advantage that both indicating devices as well as devics for generating pulse trains, which permit the position of the web to be shifted or changed when the press is being set up or is in automatic operating mode according to the setting at the control desk, can be positioned without difficulty far away from one another because they are readily switchable in parallel and do not require any feedback equipment.

The foregoing is a description corresponding in substance to German Application No. P 32 18 866.8, dated May 19, 1982, the International priority of which is being claimed for the instant application, and which is hereby made part of this application. Any material discrepancies between the foregoing specification and the aforementioned corresponding German application are to be resolved in favor of the latter.

We claim:

1. Device for determining and adjusting the position of a web, the device having two sensor units each with a respective light source element directed towards the web and a respective photoelectric sensor element responsive to reflected light, a control unit responsive to respective output signals of the two sensor units, and a device connected to the control unit and fed by an adjusting signal from the control unit for adjusting the position of the web, comprising reflectors disposed at a side of the web facing away from the sensor units and projecting beyond respective opposite edgs of the web, one of the two elements of one of the sensor units being directed towards one of said opposite edges of the web and the other of the two elements of said one of the sensor units being directed to a reference surface, one of the two elements of the other sensor unit being directed towards the other of said opposite edges of the web and the other of the two elements of said other sensor unit being also directed to a reference surface, the adjusting signal fed from the control unit to the adjusting device being a function of the difference of the two output signals of the two sensor units, at least one of the two sensor units being coupled via a low-pass filter to the control unit means for feeding a control signal to the control unit for addition to the output signal of one of the sensor units, means for feeding the output signals of the two sensor units to a first comparator having an output signal, means for feeding said output signal of said first comparator and said control signal to the second comparator having an output delivering a adjusting signal, and means for adding said control signal to the output signal of one of the sensor units as said second comparator responds to said control signal and the output signal of the first comparator, and the device having means for converting from manual to automatic operating mode, including means for storing, at the instant of conversion to the automatic operating mode, said output signal of said first comparator generated during the manual operating mode, and means for feeding said stored output signal of said first comparator to said second comparator as a control signal during the automatic operating mode.

2. Device according to claim 1 wherein the output signal of said first comparator is in analog form, and including an analog-to-digital converter for converting said analog output signal into a digital signal, a digital memory connected to said converter for receiving said digital signal at the instant of conversion from the manual to the automatic operating mode, and a digital-to-analog converter for converting said signal received in said digital memory to said control signal fed to said second comparator, the content of said digital memory being variable for randomly changing said control signal.

3. Device according to claim 2 wherein said digital memory is formed by a counter.

4. Device according to claim 2 wherein said digital memory is coupled to a counter.

* * * * *